US011896152B2

(12) United States Patent
Pesina

(10) Patent No.: US 11,896,152 B2
(45) Date of Patent: Feb. 13, 2024

(54) SYSTEM AND METHOD FOR A FITTED ELASTIC BED SHEET

(71) Applicant: Vanessa Mojica Pesina, Lubbock, TX (US)

(72) Inventor: Vanessa Mojica Pesina, Lubbock, TX (US)

( * ) Notice: Subject to any disclaimer, the term of this patent is extended or adjusted under 35 U.S.C. 154(b) by 702 days.

(21) Appl. No.: 16/912,896

(22) Filed: Jun. 26, 2020

(65) Prior Publication Data

US 2020/0383503 A1 Dec. 10, 2020

Related U.S. Application Data

(63) Continuation-in-part of application No. 16/893,661, filed on Jun. 5, 2020, now abandoned.

(60) Provisional application No. 62/857,817, filed on Jun. 6, 2019.

(51) Int. Cl.
*A47G 9/02* (2006.01)

(52) U.S. Cl.
CPC ..... *A47G 9/0246* (2013.01)

(58) Field of Classification Search
CPC ..... A47G 9/0238; A47G 9/0246; A47G 9/04; A47G 9/0292
See application file for complete search history.

(56) References Cited

U.S. PATENT DOCUMENTS 2,942,280 A * 6/1960 May, Jr. ..... A47G 9/0246 5/497
4,703,530 A * 11/1987 Gusman ..... A47G 9/0246 5/497
4,962,546 A * 10/1990 Vitale ..... A47C 31/105 5/500
5,127,115 A * 7/1992 Williams ..... A47G 9/0246 112/475.08
5,287,574 A * 2/1994 Kardell ..... A47C 31/105 5/500
5,325,555 A * 7/1994 Whitley ..... A47C 31/105 5/500
5,625,912 A * 5/1997 McCain ..... A47G 9/0246 5/500
5,636,393 A * 6/1997 Zafiroglu ..... A47G 9/0246 428/102
6,119,290 A * 9/2000 Masoncup ..... A47G 9/0292 5/493

(Continued)

*Primary Examiner* — Eric J Kurilla
(74) *Attorney, Agent, or Firm* — G. Michael Roebuck; The Moster Law Firm

(57) ABSTRACT

An easily foldable fitted sheet is disclosed, made of a flat top section with a backside of fabric flat against a backside of the flat bottom section joined together at their outlining edges. The flat top section is an inelastic rectangular sheet of fabric sewn all around at the outlining edges to the flat bottom section which is an elastic rectangular frame of fabric with no middle center and only one seam. The top portion can be made of an elastic material. When the fitted sheet's flat bottom section is stretched over any mattress it forms the side panels giving a tight fit and grips the underside of the mattress with the silicone beading or strip that is adhered to the inside edge of the bottom section. When the sheet is released from the mattress the bottom section's elastic material retains its flat rectangular shape and lies flat for ease of folding and storage.

18 Claims, 9 Drawing Sheets

SIDE VIEW OF TOP PORTION & BOTTOM PORTION OVER MATTRESS

SIDE VIEW SHOWING BOTTOM PORTION UNDERSIDE OF MATTRESS

(56) References Cited

U.S. PATENT DOCUMENTS

| | | | | |
|---|---|---|---|---|
| 6,353,947 | B1 * | 3/2002 | McCain | A47G 9/0246 5/500 |
| 6,842,921 | B1 * | 1/2005 | Tsiarkezos | A47G 9/0246 5/497 |
| 7,032,262 | B2 * | 4/2006 | Creech | A47G 9/0246 5/497 |
| 7,398,570 | B2 * | 7/2008 | Seago | A47G 9/0246 5/497 |
| 8,990,981 | B2 * | 3/2015 | Bensoussan | A47G 9/0246 5/497 |
| 9,820,592 | B2 * | 11/2017 | Feldman | A47G 9/0246 |
| 10,104,981 | B2 * | 10/2018 | Nekhala | A47G 9/0246 |
| 2008/0078029 | A1 * | 4/2008 | Seago | A47G 9/0246 5/497 |
| 2009/0205134 | A1 * | 8/2009 | Wootten, Jr. | A47G 9/04 5/488 |
| 2013/0239328 | A1 * | 9/2013 | Rose | A47G 9/0246 5/497 |
| 2014/0109315 | A1 * | 4/2014 | Lilienthal | A47G 9/0246 5/497 |
| 2015/0020311 | A1 * | 1/2015 | Bensoussan | A47G 9/0246 5/497 |
| 2020/0288888 | A1 * | 9/2020 | Doshi | A47C 31/105 |
| 2021/0169245 | A1 * | 6/2021 | Billups | A47G 9/0246 |
| 2021/0177167 | A1 * | 6/2021 | Jain | A47G 9/04 |
| 2022/0031097 | A1 * | 2/2022 | Martin | A47G 9/0246 |
| 2022/0378232 | A1 * | 12/2022 | Norton | A47G 9/0238 |

* cited by examiner

EASE OF FOLDING FLAT A FITTED BED SHEET
VARIATION #1
FIG. 1. SIDE VIEW OF TOP PORTION & BOTTOM PORTION OVER MATTRESS
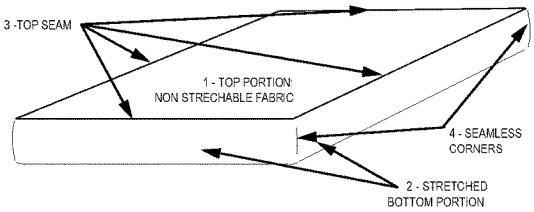
FIG. 3. SIDE VIEW SHOWING BOTTOM PORTION UNDERSIDE OF MATTRESS
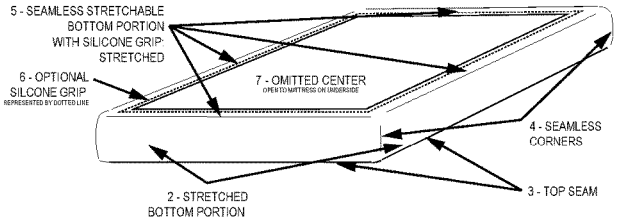
FIG. 2. TOP VIEW OVER MATTRESS
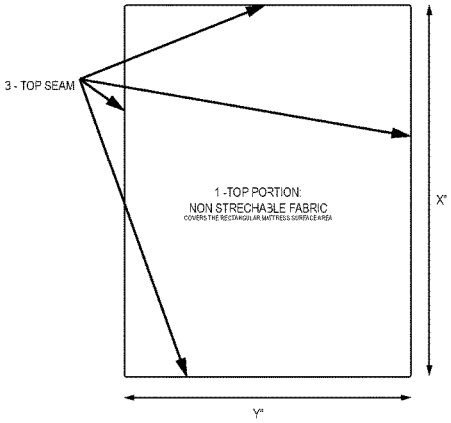
FIG. 4. BOTTOM VIEW UNDER MATTRESS
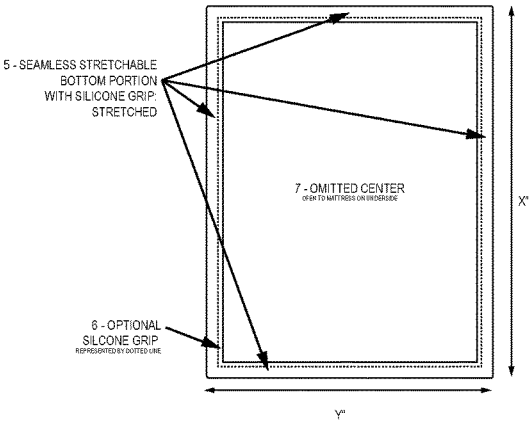

EASE OF FOLDING FLAT A FITTED BED SHEET
VARIATION #1
FIG. 5. EXPLODED VIEW OF TOP PORTION & BOTTOM PORTION
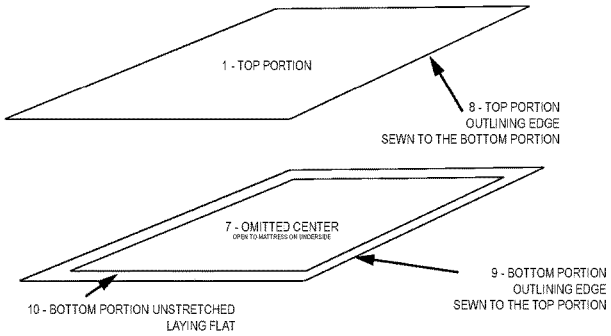
FIG. 7. FOLDED VIEW
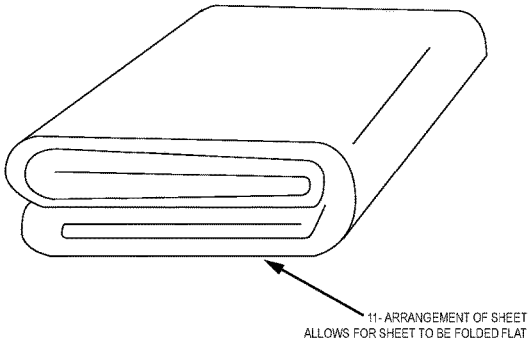
FIG. 6. UNSTRETCHED EXPLODED SIDE VIEW TOP PORTION & BOTTOM PORTION
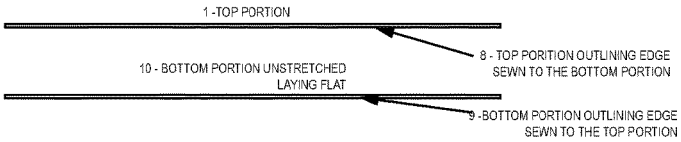

EASE OF FOLDING FLAT A FITTED BED SHEET
VARIATION #2
FIG. 8. SIDE VIEW OF TOP PORTION & BOTTOM PORTION OVER MATTRESS
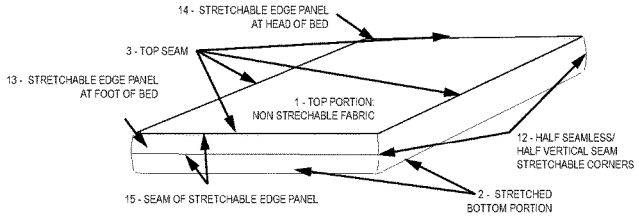
FIG. 10. SIDE VIEW SHOWING BOTTOM PORTION UNDERSIDE OF MATTRESS
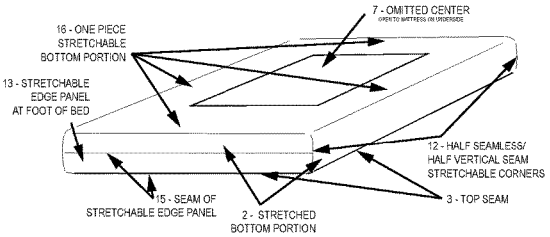
FIG. 9. TOP VIEW OVER MATTRESS
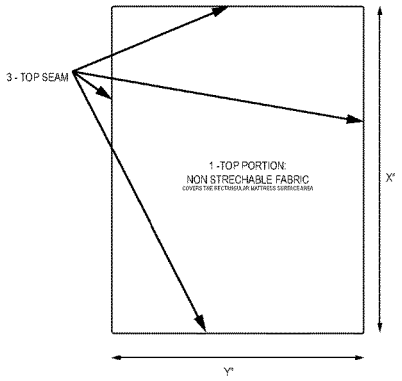
FIG. 11. BOTTOM VIEW UNDER MATTRESS
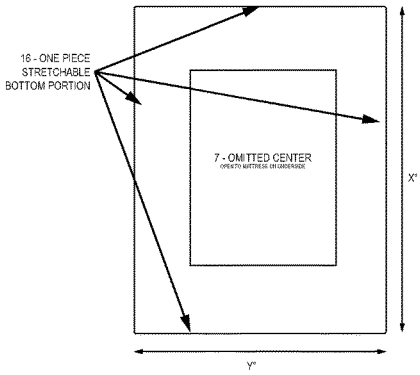

EASE OF FOLDING FLAT A FITTED BED SHEET
VARIATION #2
FIG. 12. EXPLODED VIEW OF TOP PORTION & BOTTOM PORTION WITH EXTENDED BORDERS
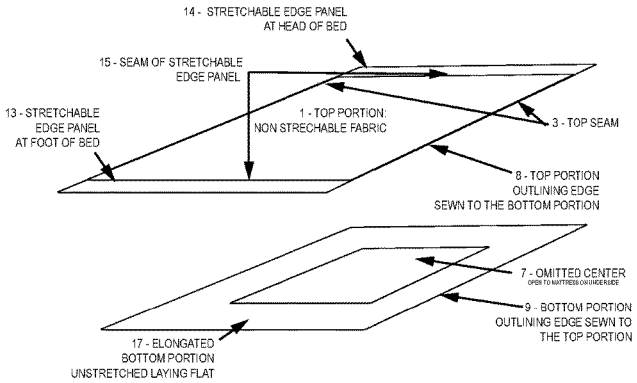
FIG. 13. UNSTRETCHED EXPLODED SIDE VIEW TOP PORTION & BOTTOM PORTION
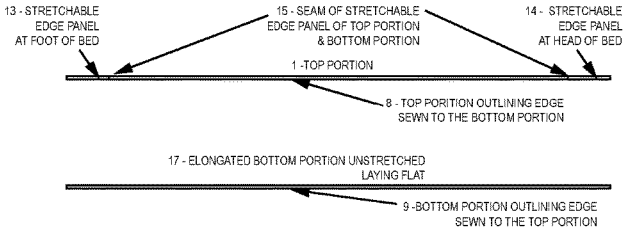
FIG. 14. FOLDED VIEW
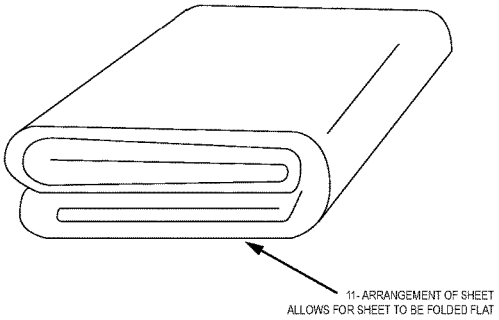

EASE OF FOLDING FLAT A FITTED BED SHEET
VARIATION #3
FIG. 15. SIDE VIEW OF TOP PORTION & BOTTOM PORTION OVER MATTRESS
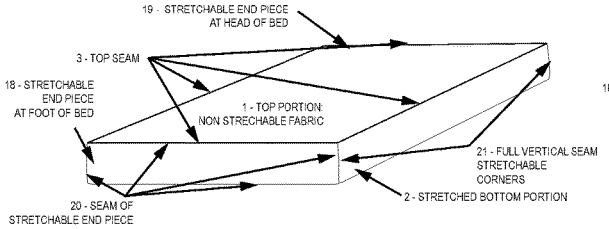
FIG. 17. SIDE VIEW SHOWING BOTTOM PORTION UNDERSIDE OF MATTRESS
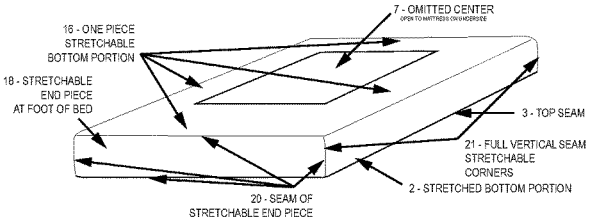
FIG. 16. TOP VIEW OVER MATTRESS
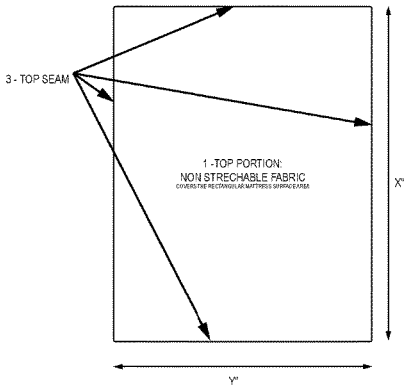
FIG. 18. BOTTOM VIEW UNDER MATTRESS
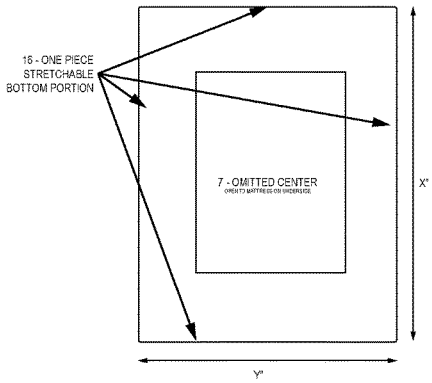

EASE OF FOLDING FLAT A FITTED BED SHEET
VARIATION #3
FIG. 19. EXPLODED VIEW OF TOP PORTION & BOTTOM PORTION WITH EXTENDED BORDERS
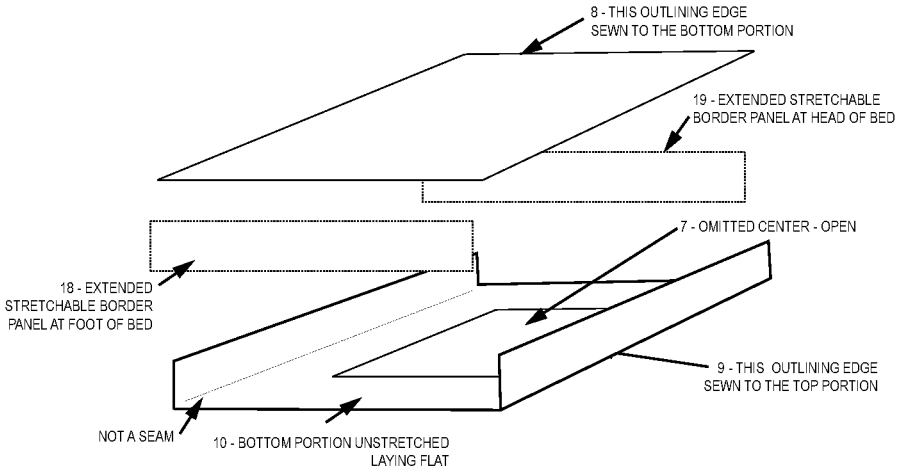

FIG. 21. DETAILED SIDE VIEW OF EXTENDED BORDER PANEL, TOP PORTION, & BOTTOM PORTION COMPOSITION
(SAME FOR HEAD & FOOT OF BED)
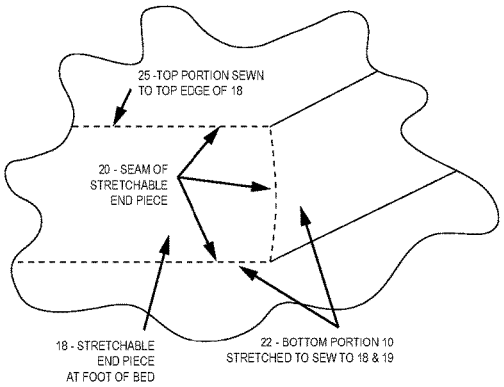
FIG. 20. UNSTRETCHED EXPLODED SIDE VIEW TOP PORTION & BOTTOM PORTION
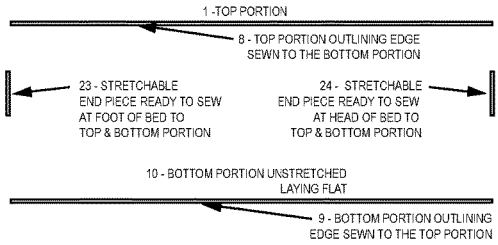
FIG. 22. FOLDED VIEW
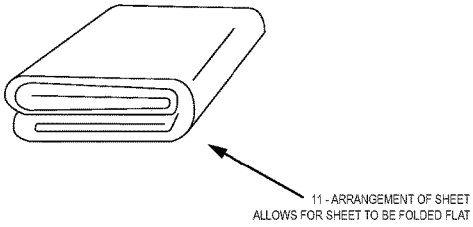

SYSTEM AND METHOD FOR A FITTED ELASTIC BED SHEET

CROSS REFERENCE TO RELATED APPLICATIONS

This patent application takes priority from U.S. provisional patent application No. 62/857,817 filed on Jun. 6, 2019 by Vanessa M. Pesina and entitled Ease of Folding Flat a Fitted Bed Sheet and U.S. nonprovisional patent application Ser. No. 16/893,661 filed on Jun. 5, 2020 by Vanessa M. Pesina and entitled A System and Method for A Fitted Elastic Bed Sheet which are both hereby incorporated by reference in its entirety.

FIELD OF THE INVENTION

The present invention relates to fitted sheets.

BACKGROUND OF THE INVENTION

There are many drawbacks to the typical fitted sheet. These drawbacks include the way a typical fitted sheet is put onto a bed mattress. The typical fitted sheet has elasticized edges all around and does not lay flat. There is no stretch to the fabric just the elastic cord, therefore, when tucking the corner of the sheet under the mattress the rest of the sheet is pulled the same direction due to the tension from the elastic bands causing it to curdle.

Another drawback is how difficult it is to fold fitted sheets. Due to the sewn in elastic, whether all around, down the edges, or at the head and foot of the sheet, a typical folded fitted sheet turns into a mound of a mess when attempting to fold because of the 360 degree elastic cord. The sheet is bundled into a mound which has substantially no structure to fold.

To highlight another problem with current fitted sheets is that zipper and expandable panel sheets may have ease in folding but do not address the amount of time involved in installing a zipper or expandable panel fitted sheet. When the sheet is put on, the aesthetics of the sheet have more of a mechanical feature. The more mechanical the sheet the more time involved because there is some installation required. Also with zipper sheets it contains a separate piece that is not foldable.

SUMMARY OF THE INVENTION

A fitted bed sheet is disclosed comprising a top section and stretchable bottom section/material made of two different fabrics backside facing backside sewn together with one seam all around making one piece. The top section can also be made of an elastic material or an inelastic material. The fitted sheet lies flat and has extended bottom fabric on the top section on two parallel sides making it easier to stretch over and put on a mattress and is able to fold flat with ease and makes easy storage.

BRIEF DESCRIPTION OF THE DRAWINGS

FIG. 1 is a schematic depiction a particular illustrative embodiment of the invention depicting a side view of a fitted bed sheet, fitted over a mattress wherein the fitted bed sheet is positioned and stretched over the mattress;

FIG. 2 is a schematic depiction a particular illustrative embodiment of the invention of a top view of fitted sheet over mattress depicting fitted bed sheet positioned and stretched over the mattress, showing a flat top section made with inelastic material and covering the top surface area of the mattress. In another particular embodiment the top section is made of an elastic material.

FIG. 3 is a schematic depiction a particular illustrative embodiment of the invention of side view of underside with fitted sheet over mattress—bottom reflection: fitted bed sheet positioned over the mattress, showing flat bottom section made with elastic fabric and the extended pieces stretched over the sides of the head and foot of the mattress;

FIG. 4 is a schematic depiction a particular illustrative embodiment of the invention of depicting a bottom view of underside with fitted sheet over mattress: full underside view of the mattress with the fitted bed sheet positioned and stretched over the mattress;

FIG. 5 is a schematic depiction a particular illustrative embodiment of the invention of depicting an exploded view of top section and bottom section—top view not over mattress;

FIG. 6 is a schematic depiction a particular illustrative embodiment of the invention of exploded view of top section and bottom section;

FIG. 7 depicts a view of the folded bed sheet;

FIG. 8 is a schematic depiction a particular illustrative embodiment of the invention depicting a side view of a fitted bed sheet, fitted over a mattress wherein the fitted bed sheet is positioned and stretched over the bed mattress;

FIG. 9 is a schematic depiction a particular illustrative embodiment of the invention of a top view of fitted sheet over mattress depicting fitted bed sheet positioned and stretched over the mattress, showing a flat top section made with inelastic material and covering the top surface area of the mattress;

FIG. 10 is a schematic depiction a particular illustrative embodiment of the invention of side view of underside with fitted sheet over mattress—bottom reflection: fitted bed sheet positioned over the mattress, showing flat bottom section made with elastic fabric and the extended pieces stretched over the sides of the head and foot of the mattress;

FIG. 11 is a schematic depiction a particular illustrative embodiment of the invention of depicting a bottom view of underside with fitted sheet over mattress: full underside view of the mattress with the fitted bed sheet positioned and stretched over the mattress;

FIG. 12 is a schematic depiction a particular illustrative embodiment of the invention of depicting an exploded view of top section and bottom section—top view not over mattress;

FIG. 13 is a schematic depiction a particular illustrative embodiment of the invention of exploded view of top section and bottom section;

FIG. 14 depicts a view of the folded bed sheet;

FIG. 15 is a schematic depiction a particular illustrative embodiment of the invention of depicting a side view of a fitted bed sheet, fitted over a mattress wherein the fitted bed sheet is positioned and stretched over the bed mattress, showing a flat top section covering a top surface of the mattress of the fitted bed sheet made of an inelastic material and a bottom section made of an elastic material that is stretched over the sides and a bottom of the mattress to make the side panels and hold the fitted bed sheet in place on the mattress. The extended stretchable fabric sewn to the top section of the fitted bed sheet stretches over and covers the sides and a portion of the bottom of the mattress of the head and foot of the mattress;

FIG. 16 is a schematic depiction a particular illustrative embodiment of the invention of a top view of fitted sheet over mattress depicting fitted bed sheet positioned and stretched over the mattress, showing a flat top section made with inelastic material and covering the top surface area of the mattress;

FIG. 17 is a schematic depiction a particular illustrative embodiment of the invention of side view of underside with fitted sheet over mattress—bottom reflection: fitted bed sheet positioned over the mattress, showing flat bottom section made with elastic fabric and the extended pieces stretched over the sides of the head and foot of the mattress and the seam less framed bottom section wraps the sides and continues to the underside of the mattress with or without silicone grip that runs along the inside edges of the bottom section but not needed;

FIG. 18 is a schematic depiction a particular illustrative embodiment of the invention of depicting a bottom view of underside with fitted sheet over mattress: full underside view of the mattress with the fitted bed sheet positioned and stretched over the mattress, showing the run-off from the side panels of the flat bottom section stretching under the mattress, showing the frame of stretchable fabric around the inside edges of the bottom section of the sheet;

FIG. 19 is a schematic depiction a particular illustrative embodiment of the invention of depicting an exploded view of top section and bottom section—top view not over mattress: fitted bed sheet not in its intended position nor joined together as the complete fitted sheet, showing the inelastic flat top section with stretchable/elastic extending fabric at the head and foot detached from the elastic, flat, bottom section;

FIG. 20 is a schematic depiction a particular illustrative embodiment of the invention of exploded view of top section and bottom section—side view not over mattress: fitted bed sheet not in its intended position nor joined together as the complete sheet, showing the inelastic, flat top section detached from and facing the elastic, four way stretchable flat, bottom section. In another particular embodiment the top section is made of an elastic material;

FIG. 21 is a schematic depiction a particular illustrative embodiment of the invention of side view of corner of fitted sheet manufactured as one solid piece showing top section and bottom section of fitted sheet manufactured as one solid piece. The drawings presented herein are for illustrative purposes only and do not limit the scope of the claims. Rather, the drawings are intended to help enable one having ordinary skill in the art to make and use the claimed inventions; and FIG. 22 depicts a view of the folded bed sheet.

DETAILED DESCRIPTION OF AN ILLUSTRATIVE EMBODIMENT OF THE INVENTION

Figure 23:
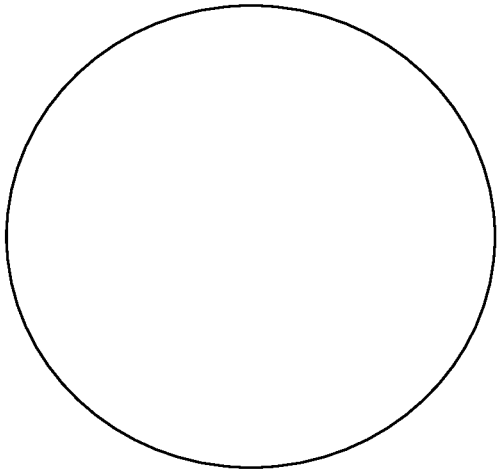
FIG. 23 is a top view of a particular illustrative embodiment of the invention, wherein the top and bottom sections are circular to fit a circular bed.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural detail, nor do they limit the scope of the claims.

The reference numerals used herein correspond to the following elements shown in the drawings.

1—Top Portion: Non Stretchable Fabric. In another particular embodiment the top section is made of an elastic material.
2—Stretched Bottom Portion
3—Top Seam
4—Seamless Corners
5—Seamless Stretchable Bottom Portion With Silicone Grip: Stretched
6—Optional Silicone Grip: Represented By Dotted Line
7—Omitted Center: Open To Mattress On Underside
8—Top Portion Outlining Edge Sewn To Bottom Portion
9—Bottom Portion Outlining Edge Sewn To Top Portion
10—Bottom Portion Unstretched Laying Flat
11—Arrangement Of Sheet Allows For Sheet To Be Folded Flat
12—Half Seamless/Half Vertical Seam Stretchable Corners
13—Stretchable Edge Panel At Foot Of Bed
14—Stretchable Edge Panel At Head Of Bed
15—Seam Of Stretchable Edge Panel
16—One Piece Stretchable Bottom Portion
17—Elongated Bottom Portion Unstretched Laying Flat
18—Stretchable End Piece At Foot Of Bed
19—Stretchable End Piece At Head Of Bed
20—Seam Of Stretchable End Piece
21—Full Vertical Seam Stretchable Corners
22—Bottom Portion Stretched To Sew To 18 and 19
23—Stretchable End Piece Ready To Sew At Foot Of Bed To Top & Bottom Portion
24—Stretchable End Piece Ready To Sew At Head Of Bed To Top & Bottom Portion
25—Top Portion Sewn To Top Edge Of 18

Turning now to FIG. 1, FIG. 1 is a schematic depiction a particular illustrative embodiment of the invention depicting a side view of a fitted bed sheet, fitted over a mattress wherein the fitted bed sheet is positioned and stretched over the bed mattress.

Turning now to FIG. 2, FIG. 2 is a schematic depiction a particular illustrative embodiment of the invention of a top view of fitted sheet over mattress depicting fitted bed sheet positioned and stretched over the mattress, showing a flat top section made with inelastic material and covering the top surface area of the mattress.

In another particular embodiment, the top portion is made of an elastic material.

Turning now to FIG. 3, FIG. 3 is a schematic depiction a particular illustrative embodiment of the invention of side view of underside with fitted sheet over mattress—bottom reflection: fitted bed sheet positioned over the mattress, showing flat bottom section made with elastic fabric and the extended pieces stretched over the sides of the head and foot of the mattress. A seamless elastic bottom section silicone grip 5 is shown stretched in FIG. 3.

Turning now to FIG. 4, FIG. 4 is a schematic depiction a particular illustrative embodiment of the invention of depicting a bottom view of underside with fitted sheet over mattress: full underside view of the mattress with the fitted bed sheet positioned and stretched over the mattress. Seamless corners 4 are shown in FIG. 4. A seamless elastic bottom section silicone grip 6 is shown stretched in FIG. 3.

Turning now to FIG. 5, FIG. 5 is a schematic depiction a particular illustrative embodiment of the invention of depicting an exploded view of top section 1 and bottom section—top view not over mattress. FIG. 5 shows the outlining edge 9 sewn to the top section 1 and bottom section unstretched laid flat 10.

Turning now to FIG. 6, FIG. 6 is a schematic depiction a particular illustrative embodiment of the invention of exploded view of top section and bottom section.

Turning now to FIG. 7, FIG. 7 depicts a view of the folded bed sheet.

Turning now to FIG. 8, FIG. 8 is a schematic depiction a particular illustrative embodiment of the invention depicting a side view of a fitted bed sheet, fitted over a mattress wherein the fitted bed sheet is positioned and stretched over the bed mattress. A half seamless/half vertical seam 12 is shown. An extended stretchable border 13 is shown at the foot of the bed. An extended stretchable border of the top and bottom sections and bottom section seam 15 is shown.

Turning now to FIG. 9, FIG. 9 is a schematic depiction a particular illustrative embodiment of the invention of a top view of fitted sheet over mattress depicting fitted bed sheet positioned and stretched over the mattress, showing a flat top section made with inelastic material and covering the top surface area of the mattress.

Turning now to FIG. 10, FIG. 10 is a schematic depiction a particular illustrative embodiment of the invention of side view of underside with fitted sheet over mattress—bottom reflection: fitted bed sheet positioned over the mattress, showing flat bottom section made with elastic fabric and the extended pieces stretched over the sides of the head and foot of the mattress.

Turning now to FIG. 11, FIG. 11 is a schematic depiction a particular illustrative embodiment of the invention of depicting a bottom view of underside with fitted sheet over mattress: full underside view of the mattress with the fitted bed sheet positioned and stretched over the mattress.

Turning now to FIG. 12, FIG. 12 is a schematic depiction a particular illustrative embodiment of the invention of depicting an exploded view of top section 1 and bottom section—top view not over mattress. An elongated bottom section 17 unstretched and laying flat is shown.

Turning now to FIG. 13, FIG. 13 is a schematic depiction a particular illustrative embodiment of the invention of exploded view of top section and bottom section.

Turning now to FIG. 14, FIG. 14 depicts a view of the folded bed sheet.

Turning now to FIG. 15, in a particular illustrative embodiment of the invention, a fitted bed sheet is disclosed, wherein the fitted bed sheet is arranged and sewn with an inelastic top section 1 and a stretchable bottom section made of two different fabrics sewn together with a top seam 3 wherein the top section 1 has extending pieces made of the bottom section's material where the sheet will lay at the head and foot of the mattress. The seam 3 is sewn at the bordering edge connecting the top and bottom sections together with the top and bottom sections facing backside to backside to make a one-piece fitted sheet. The design of the sheet allows two major objectives to be achieved. First, the arrangement of the flat top section 1 and flat bottom section laid flat against each other are sewn together at their outside edges creating a main seam 3 for the structure of the fitted sheet to maintain a flat in shape, fold flat with ease, and makes for easy storage. Second, the composition of the two different materials in this way and structure of the inelastic, rigid flat top section 1 and flat, elastic/stretchable, bottom section sewn together at the perimeter of each material allows for the sheet to maintain a flat shape but allow the bottom section to stretch and wrap around the mattress so that the bottom elastic section extends and continues to the underside of the mattress then retracts back to a flat sheet when removed from the mattress. This allows for the sheet to keep a flat shape for folding. Third, this fitted bed sheet design omits the need for strip of silicone or any other elastomer beading, taping, interlacing, banding, cord, or bonding around the inside edge of the bottom section to help secure the sheet to the mattress. There is no 360 degree of elastic needed or in place in a particular illustrative embodiment of the invention. The terms "section" and "portion" are used herein interchangeably.

FIG. 15 is a schematic depiction a particular illustrative embodiment of the invention of side view of fitted sheet over mattress. The Fitted Bed Sheet has a flat top section 1 composed of inelastic material for structure with a border at the head and foot of stretchable/elastic fabric/material while the flat bottom section is composed entirely of elastic stretchable material with flexibility to stretch over the mattress for a tight fit. The flat top section 1 backside of the fabric lays flat against the backside of the flat bottom section. The top and bottom sections are joined together with a main seam 3 around the outlining edges that make up one single piece fitted bed sheet, having a top section 1 and a bottom section.

The composition of the top and bottom sections differs. The top section 1 is made of combination of any inelastic material that is made in the same rectangular shape of the top surface of any mattress and stretchable/elastic material 18 that borders the head and foot 19 extending past the top rectangular surface area of the mattress and the bottom section must be comprised of seam 3 less stretchable/elastic material to stretch and retrack to a flat sheet for ease of folding. Another difference is the cut of the material for the bottom section is cut in the same rectangular shape as the top section 1 but with a middle center section omitted. The fitted sheet lays over the mattress without bunching up and the bottom section stretches and extends over the mattress. In another particular embodiment of the invention, the top and bottom sections are circular to fit a circular bed.

Figure 24:
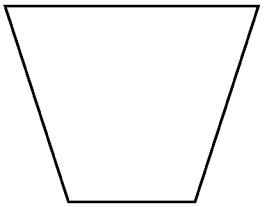
FIG. 24 is a top view of a particular illustrative embodiment of the invention, wherein the top and bottom sections are an irregular shape to fit an irregular shaped bed.

As shown in FIG. 23 in another particular embodiment of the invention, the top and bottom sections are circular to fit a circular bed. As shown in FIG. 24, in another particular embodiment of the invention, the top and bottom sections are an irregular shape to fit an irregular shaped bed.

When stretched over the mattress the flat elastic bottom section stretches to make the side panels of the fitted sheet covering the sides of the mattress and the extended stretchable borders of the top section 1 help cover the sides of the head and foot of the mattress. The combination of the two materials making up the top and bottom section, laid flat against each other are joined together with a single seam 3 at the outlining edges the top and bottom sections, which gives the flat structure of the fitted sheet for folding or deployment on a bed, but also allows for the sheet to be stretched over the mattress and wrap the mattress with a tight fit when deployed on a mattress and when taken off the mattress and unstretched top and bottom sections, it lies flat for easy folding and storing and placing on the mattress. Full vertical seam stretchable corners 21 fit over the mattress. The bottom portion 2 of the fitted sheet is stretched to fit over the mattress. In another particular embodiment a seam 20 of an extended border panel is provided as shown in FIG. 15.

Turning now to FIG. 16, FIG. 16 is a schematic depiction a particular illustrative embodiment of the invention of top view of fitted sheet over mattress. The flat top section 1 of the fitted bed sheet is the same rectangular shape in reference to the top rectangular surface of any mattress for which the fitted bed sheet is designed to accommodate, and is composed of any inelastic non-stretchable material, e.g., of woven cotton, for structure and breathability to sleep on. The flat top section 1 being sewn to an entirely different piece of material which is the flat bottom section sheet with one seam 3 all around the outlining edges allows the sheet to lie flat with substantially no bunching or pulling.

Turning now to FIG. 17, FIG. 17 is a schematic depiction a particular illustrative embodiment of the invention of side view of underside with fitted sheet over mattress—bottom reflection. The fitted bed sheet with the flat top and flat bottom sections joined together with the main seam 3 around the outlining edges makes one fitted sheet stretched over the mattress sides and bottom. The flat bottom section covers the sides of the mattress and a portion of the bottom of the mattress. The one-piece stretchable bottom section 16 of the fitted bed sheet remains a flat structure but also stretches and retracts because it is made of a flat elastic fabric that is the surface area of any mattress except with the center cut out. The bottom section 16 stretches over the mattress and creates the side panels on each side of the mattress. An omitted center opening 7 or hole in the bottom section allows the bottom section to slide over the mattress. The panels then cling to the sides and extend to the underside of the mattress and are held in place with the boarder and frame of the fabric and it can have added silicone strip or not. The top and bottom portions are cut so that they match the top surface of a mattress for which the fitted sheet is designed. For example, a fitted sheet for a king sized bed is cut to match the dimensions of the king sized bed. A fitted sheet for a twin sized bed is cut to match the dimensions of the twin sized bed. A fitted sheet for a queen sized bed is cut to match the dimensions of the queen sized bed. A fitted sheet for a circular bed is cut to match the dimensions of the circular bed. A fitted sheet for an irregular shaped bed is cut to match the dimensions of the irregular shaped bed. A full vertical seam 21 is provided at stretchable corners. A seam 20 of the extended stretchable border panel is provided.

Turning now to FIG. 18, FIG. 18 is a schematic depiction a particular illustrative embodiment of the invention of bottom view of underside with fitted sheet over mattress, the underside of the mattress showing the run off of the side panels which are formed when the flat bottom section elastic fabric is stretched over the mattress and the extended stretchable borders 18 and 19 of the top section 1 create the side panels. A one-piece stretchable bottom portion stretches over the mattress. This underside view shows the bottom section and the stretchable frame of the fitted sheet where to the bottom section of the fitted sheet wraps and clings to the underside of the mattress. In another particular illustrative embodiment of the invention an added silicone strip on the edge of the bottom section where it touches the mattress, but it is not needed. This underside view shows how the cut-out of the material for the bottom section allows the sheet to slip on and off the mattress.

Turning now to FIG. 19, FIG. 19 is a schematic depiction a particular illustrative embodiment of the invention of exploded view of top section 1 and bottom section 22 top view not over mattress, exploded view of the fitted bed sheet lying flat but stretched around to sew to 18 and 19. Showing the flat top section 1 un-attached to the flat bottom section of the fitted sheet. The top section 1 is made of inelastic material such as cotton, that is the rectangular shape of a mattress and has a stretchable material for the border where it will stretch over the head and foot of the mattress sides. The bottom section embodiment is a continuous rectangular frame-like shape with the middle removed or cutout and is composed of elastic material. This shows how both the top and bottom section have no bunching or scrunching and will lay flat back to back and showing the elastic cord is omitted and no 360 degree shape. An outlining edge 8 sewn to the bottom portion is shown. An extended stretchable border 14 at the head of the bed and an extendable stretchable border panel 19 at the foot of the bed is shown. The bottom portion 22 stretched around to sew to 18 and 19 is shown. The out lining edge 20 is sewn to the top section is shown. The open mid center portion 7 is shown for sliding over the mattress.

Turning now to FIG. 20, FIG. 20 is a schematic depiction a particular illustrative embodiment of the invention of exploded view of top section 1 and bottom section—side view not over mattress, showing flat top section 1 un-attached to the flat bottom section. The flat top section 1 is a full inelastic material with elastic/stretchable material at the head and foot boarder and the flat bottom section is a framed piece of elastic material. Both materials lay substantially flat with substantially no bunching and showing the elastic cord is omitted and no 360 degree shaped cord.

Turning now to FIG. 21, FIG. 21 is a schematic depiction a particular illustrative embodiment of the invention of detailed side view of extended border panel, top portion, & bottom portion of fitted sheet. As shown FIG. 21 a top portion 25 is sewn on top edges of the border panel is shown. An extended stretchable border panel 18 is shown. The edges 20 of the extended border panel are shown. The bottom portion 22 stretched and sewn around the sides and bottom of the border panel is shown.

FIG. 22 depicts a view of the folded fitted bed sheet. An arrangement of the fitted sheet 11 allows for the sheet to be folded flat.

The fitted sheet omits elastic sewn into the sheet all around the perimeter, corners, or as straps. The fitted sheet omits any elastic sewn to perimeters, corners, or cross pieces of bottom of sheet. The elongated bottom portion allowing more depth for the varying thicknesses of mattresses. The stretchable borders and end pieces allow for more depth for the varying thicknesses of mattresses.

In an alternative embodiment of the embodiments disclosed herein, the top portion is made of an elastic material.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

Certain specific embodiments of methods, structures, elements, and parts are described below, which are by no means an exclusive description of the inventions. Other specific embodiments, including those referenced in the drawings, are encompassed by this application and any patent that issues therefrom.

The invention claimed is:

1. A fitted bed sheet, the fitted bed sheet comprising: a flat top section and a flat seamless four way stretchable elastic bottom section; a seam that joins the top section to the flat seamless four way stretchable elastic bottom section and wherein the bottom section forms stretchable borders at a head and foot of a mattress and flat seamless four way stretchable elastic bottom section together so that the sheet maintains a flat structure as the two sections are flat against each other, wherein the flat seamless four way stretchable elastic bottom section stretches over the sides and a portion of a bottom portion of the mattress, wherein the flat seamless four way stretchable elastic bottom section has a continuous rectangular frame-like shape wherein the frame-like shape allows the flat seamless elastic bottom section to come over the mattress and it substantially ensures the sheet will grip and not slip off the mattress.

2. The fitted bed sheet of claim 1, wherein the flat top section is made of an inelastic material forming a rectangular shaped surface that matches a top sleeping surface of a mattress and extends with additional four way stretchable material at the head and foot and wherein the flat seamless four way stretchable elastic bottom section comprises a rectangular section surface with an omitted center section so that the flat seamless four way stretchable elastic bottom section over slides a portion of the bottom surface of the mattress through the omitted section.

3. The fitted bed sheet of claim 1, wherein the fitted sheet flat seamless four way stretchable elastic bottom section is able to stretch over the sides of the mattress and wraps the sides of the mattress for a tight fit and clings to the bottom side of the mattress and when removed from the mattress, retracts back to its original flat rectangular shape for ease of folding flat and storing.

4. The fitted bed sheet of claim 1, wherein the flat top section is a circular shaped surface that matches a top sleeping surface of a mattress and extends with additional stretchable material and wherein the flat seamless four way stretchable elastic bottom section comprises a circular section surface with an omitted center section so that the flat seamless four way stretchable elastic bottom section over slides a portion of the bottom surface of the mattress through the omitted section.

5. The fitted bed sheet of claim 1, wherein the flat top section is an irregular shaped surface that matches a top sleeping surface of a mattress and extends with additional four way stretchable material and wherein the flat seamless four way stretchable elastic bottom section comprises a matching irregular shaped section surface with an omitted center section so that the flat seamless four way stretchable elastic bottom section over slides a portion of the bottom surface of the mattress through the omitted section.

6. The fitted bed sheet of claim 1, wherein the fitted sheet omits additional elastic sewn into the sheet all around the perimeter, corners, or as straps.

7. The fitted bed sheet of claim 1, wherein the fitted sheet omits any additional elastic sewn to perimeters, corners, or cross pieces of the flat seamless four way stretchable elastic bottom section of sheet.

8. The fitted bed sheet of claim 1, the flat seamless four way stretchable elastic bottom section further comprising:

an elongated bottom portion allowing more depth for the varying thicknesses of mattresses.

9. The fitted bed sheet of claim 1, the stretchable borders allow for more depth for the varying thicknesses of mattresses.

10. A method for fitting a fitted bed sheet over a mattress, the method comprising:

a top section and a flat seamless four way stretchable elastic bottom section;

sliding the elastic bottom section of a fitted bed sheet over a mattress, wherein a seam that joins the top section to the seamless four way stretchable elastic bottom section and wherein the flat seamless four way stretchable elastic bottom section forms stretchable borders at a head of foot of a mattress and flat seamless four way stretchable elastic bottom section together so that the sheet maintains a flat structure as the two sections are flat against each other, wherein the flat seamless four way stretchable elastic bottom section stretches over the sides and a portion of a bottom surface of the mattress, wherein the bottom section has a continuous rectangular frame-like shape wherein the frame-like shape allows the bottom section to come over the mattress and it substantially ensures the sheet will grip and not slip off the mattress.

11. The method of claim 10, wherein the flat top section is made of an inelastic material forming a rectangular shaped surface that matches a top sleeping surface of a mattress and extends with additional four way stretchable material at the head and foot and wherein the bottom section comprises a rectangular section surface with an omitted center section so that the flat seamless four way stretchable elastic bottom section over slides a portion of the bottom surface of the mattress through the omitted section.

12. The method of claim 10, wherein the top section is made of an inelastic material and the fitted sheet flat seamless four way stretchable elastic bottom section is able to stretch over the sides of the mattress and wraps the sides of the mattress for a tight fit and clings to the bottom side of the mattress and when removed from the mattress, retracts back to its original flat rectangular shape for ease of folding flat and storing.

13. The method of claim 10, wherein the flat top section is a circular shaped surface that matches a top sleeping surface of a mattress and extends with additional stretchable material and wherein the flat seamless four way stretchable elastic bottom section comprises a circular section surface with an omitted center section so that the bottom section over slides a portion of the bottom surface of the mattress through the omitted section.

14. The method of claim 10, wherein the flat top section is an irregular shaped surface that matches a top sleeping surface of a mattress and extends with additional stretchable material and wherein the flat seamless four way stretchable elastic bottom section comprises a matching irregular shaped section surface with an omitted center section so that the flat seamless four way stretchable elastic bottom section over slides a portion of the bottom surface of the mattress through the omitted section.

15. The method of claim 10, wherein the fitted sheet omits additional elastic sewn into the sheet all around the perimeter, corners, or as straps.

16. The method of claim 10, wherein the fitted sheet omits any additional elastic sewn to perimeters, corners, or cross pieces of the flat seamless four way stretchable elastic bottom section of the sheet.

17. The method of claim 10, wherein the flat four way stretchable elastic seamless bottom section further comprises:

an elongated bottom portion allowing more depth for the varying thicknesses of mattresses.

18. The method of claim 10, wherein the four way stretchable borders allow for more depth for the varying thicknesses of mattresses.

* * * * *